US005924304A

United States Patent [19]

Sanchez

[11] Patent Number: 5,924,304

[45] Date of Patent: Jul. 20, 1999

[54] INSULATED HOLDER FOR LUNCH BOXES

[76] Inventor: Lorraine Sanchez, 44 Lenhome Dr., Cranford, N.J. 07016

[21] Appl. No.: 08/932,399

[22] Filed: Sep. 17, 1997

[51] Int. Cl.[6] ..... F25D 3/08

[52] U.S. Cl. ..... 62/457.7; 62/457.4; 62/530

[58] Field of Search ..... 62/457.4, 530, 62/457.7

[56] References Cited

U.S. PATENT DOCUMENTS 4,882,914 11/1989 Haines-Keeley et al. ..... 62/457.4

*Primary Examiner*—Henry Bennett
*Assistant Examiner*—Mark Shulman
*Attorney, Agent, or Firm*—Ezra Sutton

[57] ABSTRACT

An insulated holder for providing cool air to a beverage container and to a lunch box. The holder includes a bottom wall and sidewalls being integrally connected to form an open end and an interior cavity for receiving a beverage container therein. The bottom wall and the side walls are formed of a composite structure including a first outer layer of a plastic material, a second inner layer of a conductive material, an inner core third layer of a refrigerant material, a fourth inner layer of the conductive material, and a fifth outer layer of the plastic material. This composite structure allows cool air to flow in an inwardly direction from the inner core of refrigerant material through the fourth inner layer and the fifth outer layer to the interior cavity for cooling the beverage container. This composite structure also allows cool air to flow in an outwardly direction from the inner core of refrigerant material through the second inner layer and the first outer layer to the interior area of the lunch box for cooling of food products contained therein.

5 Claims, 4 Drawing Sheets

INSULATED HOLDER FOR LUNCH BOXES

FIELD OF THE INVENTION

This invention relates to an insulated holder for lunch boxes. More particularly, the insulated holder provides cool air to keep cold a beverage container within the insulated holder; and the holder also provides cool air to keep cold food products stored within the lunch box.

BACKGROUND OF THE INVENTION

The use of insulated holders, glasses, containers, wraps and the like for keeping a liquid beverage or a beverage container cold are well known in the art. The use of cooler packs, ice packs, and the like for keeping beverage containers, food products, and fresh fruit cold within coolers, lunch pails, and lunch boxes are also well known in the art. Lunch boxes/pails and coolers have a limited amount of volume in which to store and keep cool the beverage containers and food products contained within them.

There remains a need for an insulated holder which will provide cool air to keep cold a beverage container within the insulated holder; as well as a holder which will also provide cool air to keep cold food products, fruit, etc. stored within the lunch box/pail or cooler.

DESCRIPTION OF THE PRIOR ART

Insulated holders, containers, wraps and cooling packs having various designs, styles, configurations, appearances, and materials of construction have been disclosed in the prior art. For example, U.S. Pat. Nos. 4,183,226; 4,793,149; and 5,067,328 all disclose container holders having freezable liquids within the walls of the container holder for receiving a beverage container or the like therein.

U.S. Pat. No. 5,313,807 discloses an insulated holder with cooler pockets. The cooler pockets include flat plastic capsules in the shape of flat ice cubes.

U.S. Pat. No. 5,005,374 discloses a thermal wrap having a fabric band containing a refrigerant for surrounding a beverage container.

None of the prior art patents teach or disclose the use of an insulated holder being dual functional where the holder is used as a beverage container cooler and the holder is also used for keeping cold the contents within the lunch box or cooler.

Accordingly, it is an object of the present invention to provide an insulated holder that will transfer cool air to keep cold a beverage container within the insulated holder; and the holder will also provide cool air to keep cold other food products such as sandwiches, fruits, vegetables, and candy stored within the lunch box.

Another object of the present invention is to provide an insulated holder having walls formed of a composite laminate structure; where the outer layers are made of plastic in order to give the insulated holder a semi-rigid structure; where the inner layers are made of a conductive material in order to allow the transferring (heat transfer) of cool air from the center core (refrigerant) outwardly to the plastic layers; and an inner core third layer of a liquid refrigerant material in order to provide a cooling source within the insulated holder.

Another object of the present invention is to provide an insulated holder that is durable, easy to clean, and has a sustained cooling effect for a long period of time.

Another object of the present invention is to provide an insulated holder having various configurations and sizes for holding different sized beverage containers.

A further object of the present invention is to provide an insulated holder that can be mass produced in an automated and economical manner and is readily affordable by the consumer.

SUMMARY OF THE INVENTION

In accordance with the present invention, there is provided an insulated holder for providing cool air to a beverage container and to a lunch box. The holder includes a bottom wall and sidewalls being integrally connected to form an open end and an interior cavity for receiving a beverage container therein. The bottom wall and the side walls are formed of a composite structure including a first outer layer of a plastic material, a second inner layer of a conductive material, an inner core third layer of a refrigerant material, a fourth inner layer of the conductive material, and a fifth outer layer of the plastic material. This composite structure allows cool air to flow in an inwardly direction from the inner core of refrigerant material through the fourth inner layer and the fifth outer layer to the interior cavity for cooling the beverage container. This composite structure also allows cool air to flow in an outwardly direction from the inner core of refrigerant material through the second inner layer and the first outer layer to the interior area of the lunch box for cooling of food products contained therein.

The plastic material of the first and fifth outer layers is selected from the group consisting of acrylics, chlorinated polyesters, chlorinated polypropylenes, furanes, fluorocarbons, phenolics, polyesters, polyethylenes, silicones, urethanes and vinyls.

The conductive material of the second and fourth inner layers is selected from the group consisting of aluminum foil, brass foil, copper foil, steel foil, and stainless steel foil.

The refrigerant material of the inner core third layer is selected from the group consisting of freons, glycerins, freezing gels, plasticized gels, and brines.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED EMBODIMENT

Figure 1:
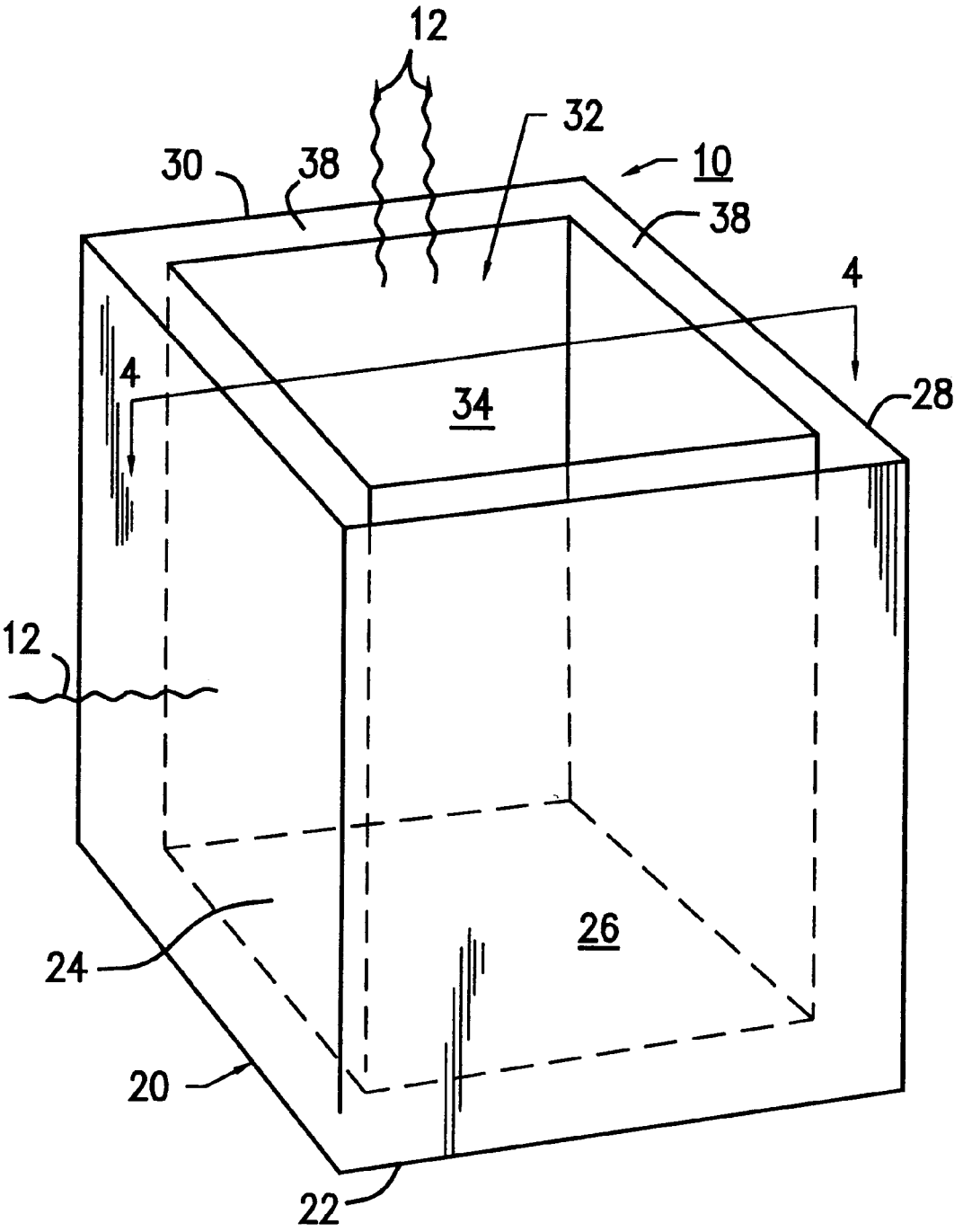
FIG. 1 is a top perspective view of the insulated holder of the preferred embodiment of the present invention showing the substantially rectangular-shaped, laminated housing having an open end and a rectangular-shaped interior cavity for receiving a beverage container.
Figure 2:
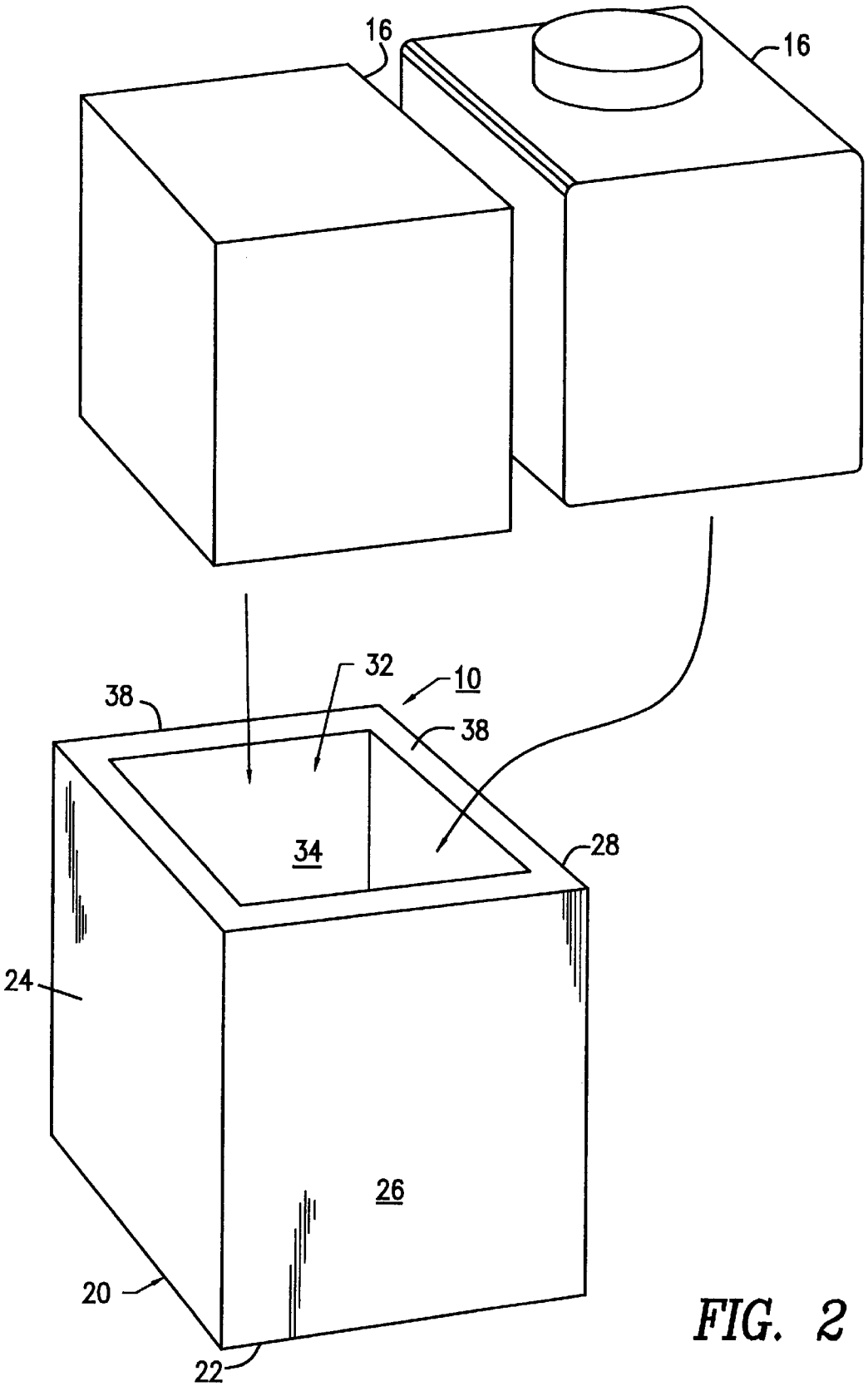
FIG. 2 is a top perspective view of the insulated holder of the present invention showing the insulated holder in operational use where the interior cavity is to receive a beverage container therein.
Figure 3:
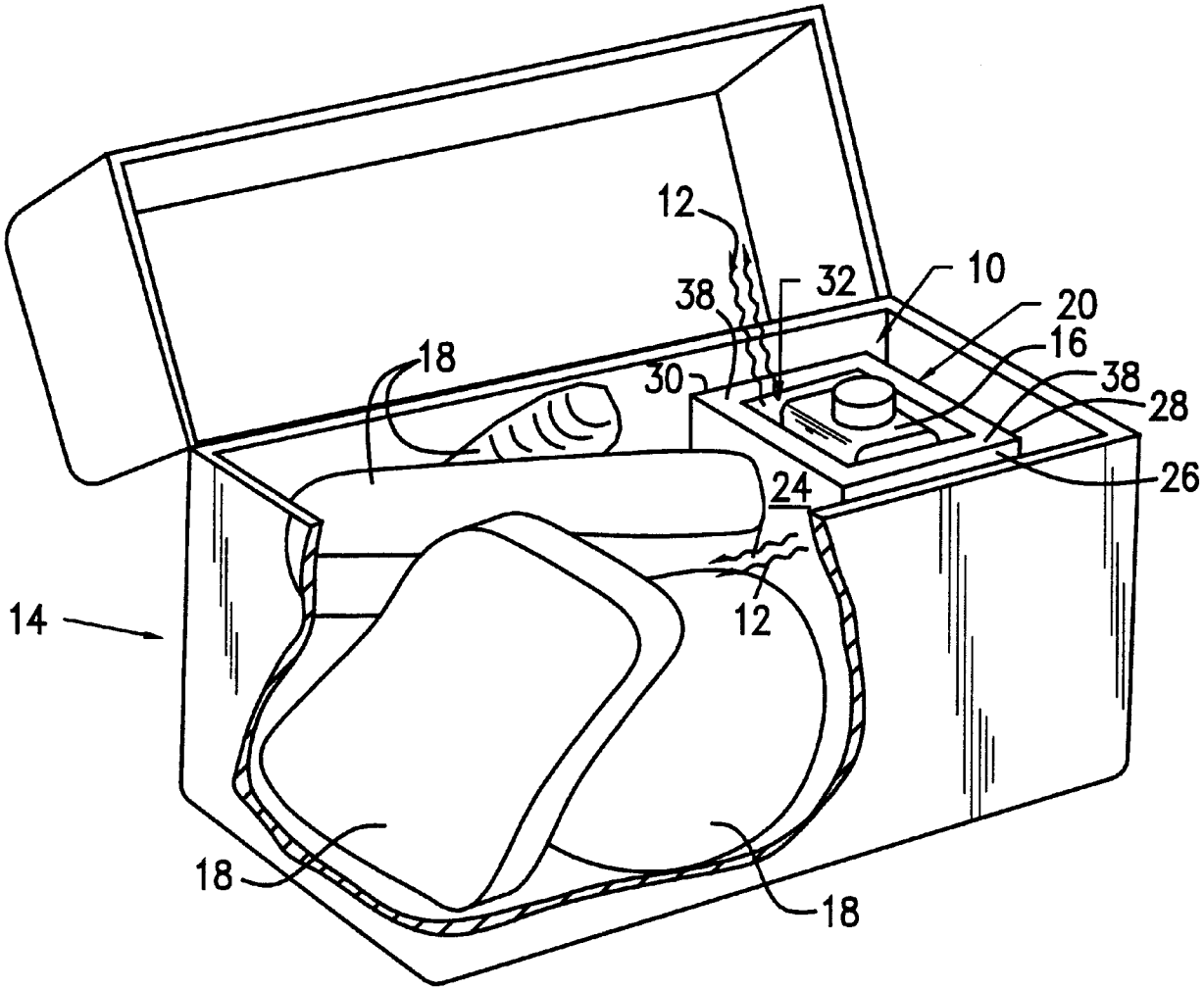
FIG. 3 is a top perspective view of the insulated holder of the present invention showing the insulated holder in operational use within a lunch box.
Figure 4:
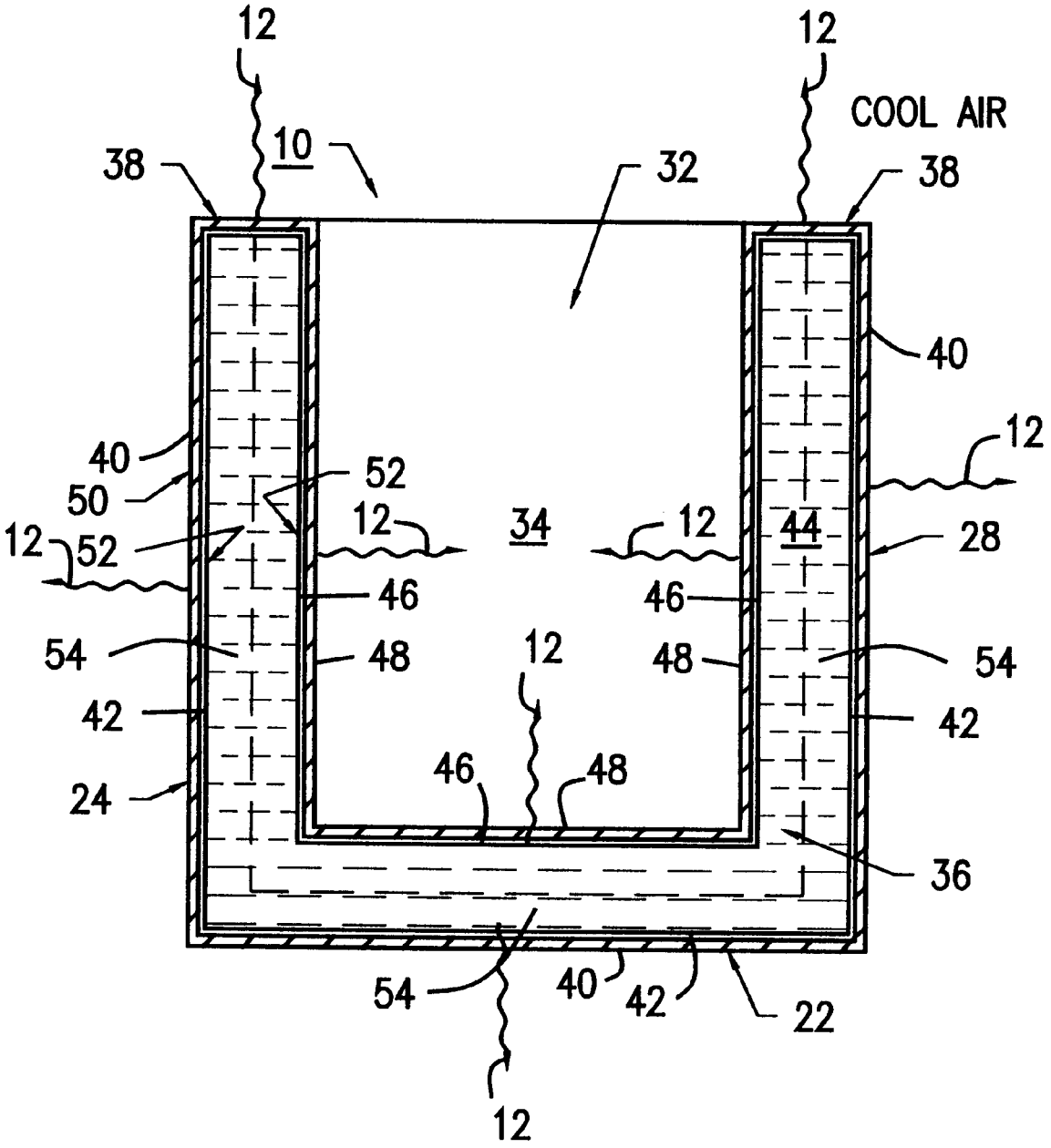
FIG. 4 is a cross-sectional view of the insulated holder taken along lines 4—4 of FIG. 1 of the present invention showing the insulated holder's composite laminated wall structure.

The insulated holder 10 is used for providing cool air 12 to a lunch box 14 in which holder 10 holds a beverage container 16 to keep it cold; and holder 10 also keeps cold food products 18 stored within the lunch box 14 when in use. Insulated holder 10 of the preferred embodiment of the present invention is represented in detail by FIGS. 1 through 4 of the drawings.

The insulated holder 10 is in the form of a substantially rectangular-shaped, laminated housing 20. Housing 20 includes a bottom wall 22 and side walls 24, 26, 28, and 30 all being integrally connected together to form an open end 32 having a perimeter edging 38 and a rectangular-shaped interior cavity 34 for receiving a beverage container 16 therein, as well as, an interior rectangular-shaped closed chamber 36 for receiving a liquid refrigerant material 54 therein.

The bottom wall 22 and each of the side walls 24 to 30 include a first outer layer 40 of a plastic material 50, a second inner layer 42 of a conductive material 52, an inner core third layer 44 of a liquid refrigerant material 54, a fourth inner layer 46 of the conductive material 52 and a fifth outer layer 48 of the plastic material 50. The perimeter edging 38 of open end 32 includes a first outer layer 40 of plastic material 50 and a second inner layer 42 of conductive material 52.

The insulated holder 10 has walls formed of a composite laminate structure 20. The outer layers 40 and 48 are made of plastic 50 in order to give the insulated holder 10 a semi-rigid structure, and the inner layers 42, 44 and 46 are made of a conductive material 52 in order to allow the transfer of cool air 12 (transfer of energy) from the center core 44 (refrigerant) outwardly to the plastic layers 40 and 48. An inner core third layer 44 of a liquid refrigerant material 54 provides a cooling source 12 within the insulated holder 10.

This composite structure 20 allows the transfer of energy or cool air 12 in an inwardly direction from the inner core 44 of refrigerant material 54 through the fourth inner layer 46 and the fifth outer layer 48 to the interior cavity 34 for cooling the beverage container 16. This composite structure 20 also allows the transfer of energy or cool air 12 in an outwardly direction from the inner core 44 of refrigerant material 54 through the second inner layer 42 and the first outer layer 40 to the interior area of the lunch box 14 for cooling of food products 18 contained therein.

The outer first layer 40 and the outer fifth layer 48 are both made of plastic material 50 selected from the group consisting of acrylics, chlorinated polyesters, chlorinated polypropylenes, fluorocarbons, furanes, phenolics, polyesters, polyethylenes, silicones, urethanes, vinyls and equivalents thereof. The second inner layer 42 and the fourth inner layer 46 are both made of conductive material 52 selected from the group consisting of aluminum foil, copper foil, brass foil, steel foil, stainless steel foil, and other metallic equivalents thereof. The inner core third layer 44 is made of a liquid refrigerant material 54 selected from the group consisting of freons, glycerins, brines, plasticized gels, freezing gels, Blue Ice™ and equivalents thereof.

ADVANTAGES OF THE PRESENT INVENTION

Accordingly, an advantage of the present invention is that it provides for an insulated holder that will transfer cool air to keep cold a beverage container within the insulated holder; and the holder will also provide cool air to keep cold other food products such as sandwiches, fruits, vegetables, and candy stored within the lunch box.

Another advantage of the present invention is that it provides for an insulated holder having walls formed of a composite laminate structure; where the outer layers are made of plastic in order to give the insulated holder a semi-rigid structure; and where the inner layers are made of a conductive material in order to allow the transferring (heat transfer) of cool air from the center core (refrigerant) outwardly to the plastic layers; and an inner core third layer of a liquid refrigerant material in order to provide a cooling source within the insulated holder.

Another advantage of the present invention is that it provides for an insulated holder that is durable, easy to clean, and has a sustained cooling effect for a long period of time.

Another advantage of the present invention is that it provides for an insulated holder having various configurations and sizes for holding different sized beverage containers.

A further advantage of the present invention is that it provides for an insulated holder that can be mass produced in an automated and economical manner and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An insulated holder for cooling a beverage container and a lunch box, comprising:

a) said holder having a bottom wall and side walls being integrally connected to form an open end and an interior cavity for receiving a beverage container therein;

b) said bottom wall and said side walls each being formed of a composite structure including a first outer layer of a plastic material, a second inner layer of a conductive material, an inner core third layer of a refrigerant material, a fourth inner layer of said conductive material, and a fifth outer layer of said plastic material; said composite allowing the transfer of energy in an inwardly direction from said inner core of refrigerant material through said fourth inner layer and said fifth outer layer to said interior cavity for cooling the beverage container; said composite also allowing the transfer of energy in an outwardly direction from said inner core of refrigerant material through said second inner layer and said first outer layer to the interior area of the lunch box for cooling of food products contained therein.

2. An insulated holder in accordance with claim 1, wherein said plastic material is selected from the group consisting of acrylics, chlorinated polyesters, chlorinated polypropylenes, furanes, fluorocarbons, phenolics, polyesters, polyethylenes, silicones, urethanes and vinyls.

3. An insulated holder in accordance with claim 1, wherein said conductive material is selected from the group consisting of aluminum foil, brass foil, copper foil, steel foil, and stainless steel foil.

4. An insulated holder in accordance with claim 1, wherein said refrigerant material is selected from the group consisting of freons, glycerins, freezing gels, plasticized gels, and brines.

5. An insulated holder in accordance with claim 1 wherein said open end includes an outer layer of a plastic material and an inner layer of a conductive material.

* * * * *